US008849146B2

(12) United States Patent
Campbell et al.

(10) Patent No.: US 8,849,146 B2
(45) Date of Patent: Sep. 30, 2014

(54) METHOD AND SYSTEM FOR EFFICIENT DUPLEX PRINTING

(71) Applicant: Lexmark International, Inc., Lexington, KY (US)

(72) Inventors: Alan Stirling Campbell, Lexington, KY (US); Christopher Edward Rhoads, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/623,594

(22) Filed: Sep. 20, 2012

(65) Prior Publication Data

US 2014/0079427 A1 Mar. 20, 2014

(51) Int. Cl.
*G03G 15/23* (2006.01)
*G03G 15/01* (2006.01)

(52) U.S. Cl.
USPC ..... 399/85; 399/402

(58) Field of Classification Search
USPC ..... 399/85, 402
See application file for complete search history.

(56) References Cited

U.S. PATENT DOCUMENTS

| | | | | |
|---|---|---|---|---|
| 7,983,585 | B2 * | 7/2011 | Miyahara | 399/82 |
| 2008/0253818 | A1 * | 10/2008 | Sasaki et al. | 399/401 |
| 2010/0310268 | A1 * | 12/2010 | Obata | 399/85 |

* cited by examiner

*Primary Examiner* — Clayton E LaBalle
*Assistant Examiner* — Leon W Rhodes, Jr.
(74) *Attorney, Agent, or Firm* — William F. Esser

(57) ABSTRACT

An imaging device, including one or more imaging units for use in transferring toner to media sheets, one of the imaging units being a black imaging unit for transferring black toner; a media transport path having a duplex path, the duplex path having at least one set of rollers for independently moving media sheets through the duplex path; and a controller operatively coupled to the one or more imaging units and the media transport path, for staging one or more media sheets in the duplex path for a period of time. The period of time results in an increase in the interpage gap which may be utilized while the imaging device interrupts a printing operation to perform any of a number of operations.

20 Claims, 2 Drawing Sheets

METHOD AND SYSTEM FOR EFFICIENT DUPLEX PRINTING

CROSS REFERENCES TO RELATED APPLICATIONS

None

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to imaging devices such as a printer or multifunction device having printing capability, and in particular to imaging devices with duplex printing having reduced churn.

2. Description of the Related Art

Printing on both sides of a sheet of media, referred to as duplex printing, provides an effective way for reducing the environmental impact of printing since less media sheets are required. However, duplex printing is inherently less efficient than simplex printing since the printing process typically continues to run during the time that the sheet is turned over and then returned to have its second side printed. This time spent running, but not printing, is called "churn" and results in additional wear on printer components as well as the toner. Additional churn is introduced when the printing process changes from a black only printing mode to a color printing mode. Color printing mode runs cyan, magenta, yellow and black imaging units to create full color prints. In black only mode, the cyan, magenta and yellow imaging units are not run since only the black imaging unit is needed. Changing print modes is desirable because time spent running the color imaging units while printing a black only image creates unwanted churn on the color imaging units and thereby shortens the useful life thereof.

Based upon the foregoing, there is a need for a more effective approach to duplex printing.

SUMMARY

Embodiments of the present disclosure overcome shortcomings of prior imaging systems and thereby satisfy a significant need for an imaging device having more efficient duplex printing. According to an example embodiment, an imaging device includes a plurality of imaging units, each imaging unit selectively deposits toner forming a color plane to be transferred to a media sheet; a media transport path configured for picking sheets of media from a stack thereof and moving the media sheets in the imaging apparatus to receive the toner forming color planes; and a fusing assembly positioned downstream along the media transport path for fusing deposited toner to the media sheets. The imaging device further includes at least one controller for controlling the imaging units, media transport path and fusing assembly. The media transport path includes a duplex path for moving media sheets from a first location downstream of the fuser assembly to a second location upstream of a point in the media transport path at which media sheets receive toner. The duplex path allows for portions of at least two media sheets of media simultaneously therein and includes a first set of rollers and a second set of rollers, each set of rollers controlled by the controller for moving the media sheets through the duplex path and selectively altering the speed of at least one media sheet therein so as to change the time of arrival of the at least one media sheet at the second location.

The capability of changing the speed of a media sheet in the duplex path to control the arrival time thereof at the second location, which may include temporarily parking the media sheet in the duplex path for a predetermined period of time, is referred to as "staging" the media sheet and advantageously allows for the imaging device to perform any of a number of actions on or with the imaging units during a printing operation without having to flush the duplex path of media sheets. For example, the imaging device may change printing modes during a printing operation while media sheets are staged in the duplex path. Changing between a color mode, in which all imaging units are operating, and a black only mode, in which only the imaging unit depositing black toner is operating, may be performed during a printing operation in this way so as to reduce churn without substantially decreasing printing throughput. The media sheet staging capability may allow for efficiently increasing the interpage gap between media sheets already in the media transport path. Increasing the interpage gap may be needed, for example, in response to an operating temperature of the fuser assembly surpassing its maximum allowable operating temperature.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings, wherein.

DETAILED DESCRIPTION

Figure 1:
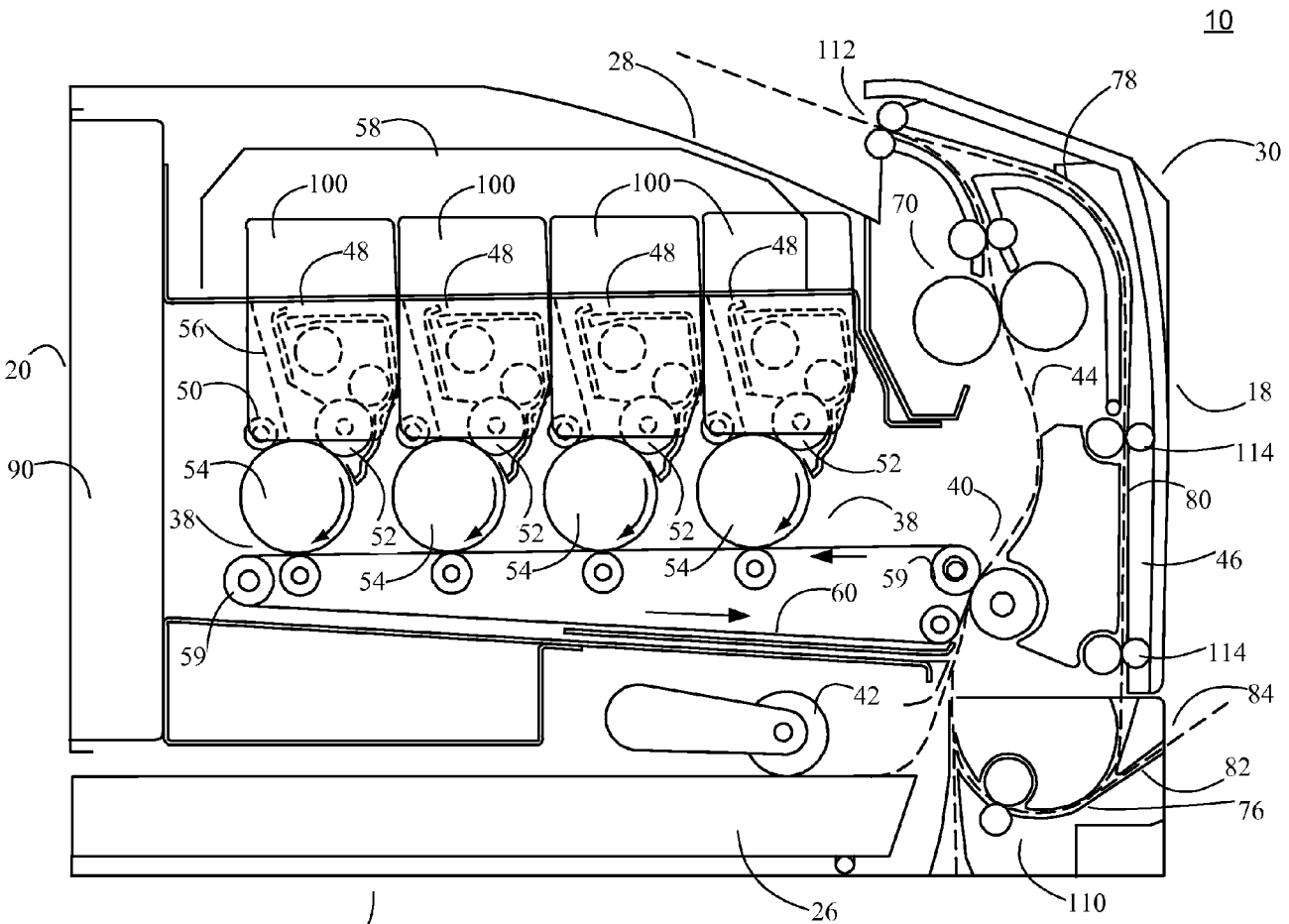
FIG. 1 is a side view of an electrophotographic imaging device according to an example embodiment of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted." and variations thereof herein are used broadly and encompass direct and indirect connections, couplings, and mountings. In addition, the terms "connected" and "coupled" and variations thereof are not restricted to physical or mechanical connections or couplings.

Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

In FIG. 1, there is shown a representative imaging device, such as a color laser printer, indicated generally by the numeral 10. The device 10 includes a body 12 having a top, a bottom, a front 18, a back 20, a first side and a second opposing side. The device 10 may include a media input tray 26 sized to contain media, and a media output area 28. It is understood that the imaging device 10 may include more than one input tray 26. A control panel 30 is accessible from the exterior to control the operation of the imaging device 10.

Imaging device 10 further includes a first toner transfer area 38, a second transfer area 40, a pick mechanism 42, a first media path 44, and a duplex path 46. The first toner transfer area 38 includes one or more imaging units 48 that may be aligned horizontally extending from the front 18 to the back 20 of the body 12. Each imaging unit 48 includes a charging roll 50, a developer roll 52, and a rotating photoconductive (PC) drum 54. The charging roll 50 forms a nip with the PC drum 54, and charges the surface of the PC drum 54 to a specified voltage, such as −900 volts, for example. A laser beam 56 from print head 58 contacts the surface of the PC drum 54 and discharges those areas it contacts to form a latent image. In one embodiment, areas on the PC drum 54 illuminated by the laser beam 56 are discharged to approximately −300 volts. The developer roll 52, which also forms a nip with the PC drum 54, is biased to about −600 volts and develops negatively charged toner particles from a cartridge or toner reservoir 100 to the PC drum 54 to form a toner image. The toner particles are attracted to the areas of the PC drum 54 surface discharged by the laser beam 56.

In one embodiment, a separate toner reservoir 100 is operatively connected to each of the imaging units 48. The toner reservoirs 100 are sized to contain toner that is transferred from the imaging units 48 for image formation. The toner reservoirs 100 may be mounted and removed from the device 10 independently from the imaging units 48. In one embodiment, the toner reservoirs 100 each contain one of black, magenta, cyan, and yellow toner. In one embodiment, each of the toner reservoirs 100 is substantially the same. In another embodiment, the toner reservoirs 100 include different capacities. In one specific embodiment, the toner reservoir that contains black toner has a higher capacity.

The imaging device 10 also includes an intermediate transfer mechanism (ITM) 60 horizontally disposed below the imaging units 48. In this embodiment, the ITM 60 is formed as an endless belt trained about a plurality of support rollers 59. However, in other embodiments, ITM 60 may be formed as a rotating drum. During image forming operations, the ITM 60 moves in the direction of the arrows past the imaging units 48. One or more of the PC drums 54 transfers toner images in their respective colors to the ITM 60. In one embodiment, a positive voltage field attracts the toner image from the PC drums 54 to the surface of the moving ITM 60. The ITM 60 then conveys the toner images to the second transfer area 40, which transfers the toner image to a media sheet, such as a sheet of paper, for example.

The media input tray 26 is sized to contain a stack of media sheets. The pick mechanism 42 is positioned adjacent to the media input tray 26 for moving an uppermost media sheet from the media input tray 26 toward the front 18 of the body 12 and into the first media path 44. In this embodiment, the pick mechanism 42 includes a roller that moves the media sheets from media input tray 26 towards the second transfer area 40 located towards the front 18 of the body 12. In one embodiment, the pick mechanism 42 is positioned in proximity (i.e., less than a length of a media sheet) to the second transfer area 40 with the pick mechanism 42 moving the media sheets from the input tray 26 to the second transfer area 40.

The first media path 44 extends between the media input tray 26 and discharge rollers 112. In this embodiment, the first media path 44 has a substantially mirror imaged C-shape. Particularly, the first media path 44 may include a first curved section that extends between the pick mechanism 42 and the second toner transfer area 40, a partly vertical section that extends between the second transfer area 40 and a fuser assembly 70, and a second curved section that extends between the fuser assembly 70 and the output media area 28. In the example embodiment, the partly vertical section extends along the front 18 of the body 12, and is disposed between a duplex media path 46 and a front-most imaging unit 48. The partly vertical section may be in front of the ITM 60, and closer to the front 18 of body 12 than any of the imaging units 48. A deflector may be disposed at the front 18 of the body 12 to guide the media sheets towards the fuser assembly 70.

The duplex media path 46 may also have a substantially mirror imaged C-shape, and extends along the front 18 of the body 12 between the output media area 28 and the first curved section of the initial media path 44. Duplex media path 46 includes a series of rollers for moving media sheets to a point upstream from the second transfer area 40 to receive a toner image on a second side of the media sheet. In this embodiment, the duplex path 46 includes a lower curved section 76, an upper curved section 78, and a generally vertical section 80 that is connected between the upper and lower curved sections 76, 78. The generally vertical section 80 extends along the front 18 of the body 12.

In the example embodiment, the lower curved section 76 shares a common media path with another feed path 82. In one embodiment, feed path 82 includes an inlet 84 for manually inserting the media sheets, and one or more rollers that move the sheets to the second transfer area 40.

Discharge rollers 112, which may include two (FIG. 1) or three (FIG. 2) rollers, are located downstream from the fuser assembly 70 and may be rotated in either forward or reverse directions. With two rollers, in a forward direction the discharge rollers 112 move the media sheet from the initial media path 44 toward the media output area 28. For duplex printing, as the trailing edge of a media sheet is near discharge rollers 112, the discharge rollers 112 reverse direction and move the media sheet into the duplex media path 46. With three rollers forming discharge rollers 112, for duplex printing a media sheet having both sides printed may pass through a first nip formed between first and second rollers of the three discharge rollers 112 for transport to media output area 28, and a media sheet having only a first side printed may pass through a second nip formed with the third roller of the discharge rollers 112 for transport to duplex media path 46.

The device 10 also includes a controller 90 to control the operation of the device 10, including image formation and motor engagement/disengagement. In one embodiment, controller 90 comprises one or more printed circuit boards (PCBs) having one or more microprocessors, random access memory, read only memory, and an input/output interface. In this embodiment, controller 90 is disposed at the back 20 of the body 12.

Figure 2:
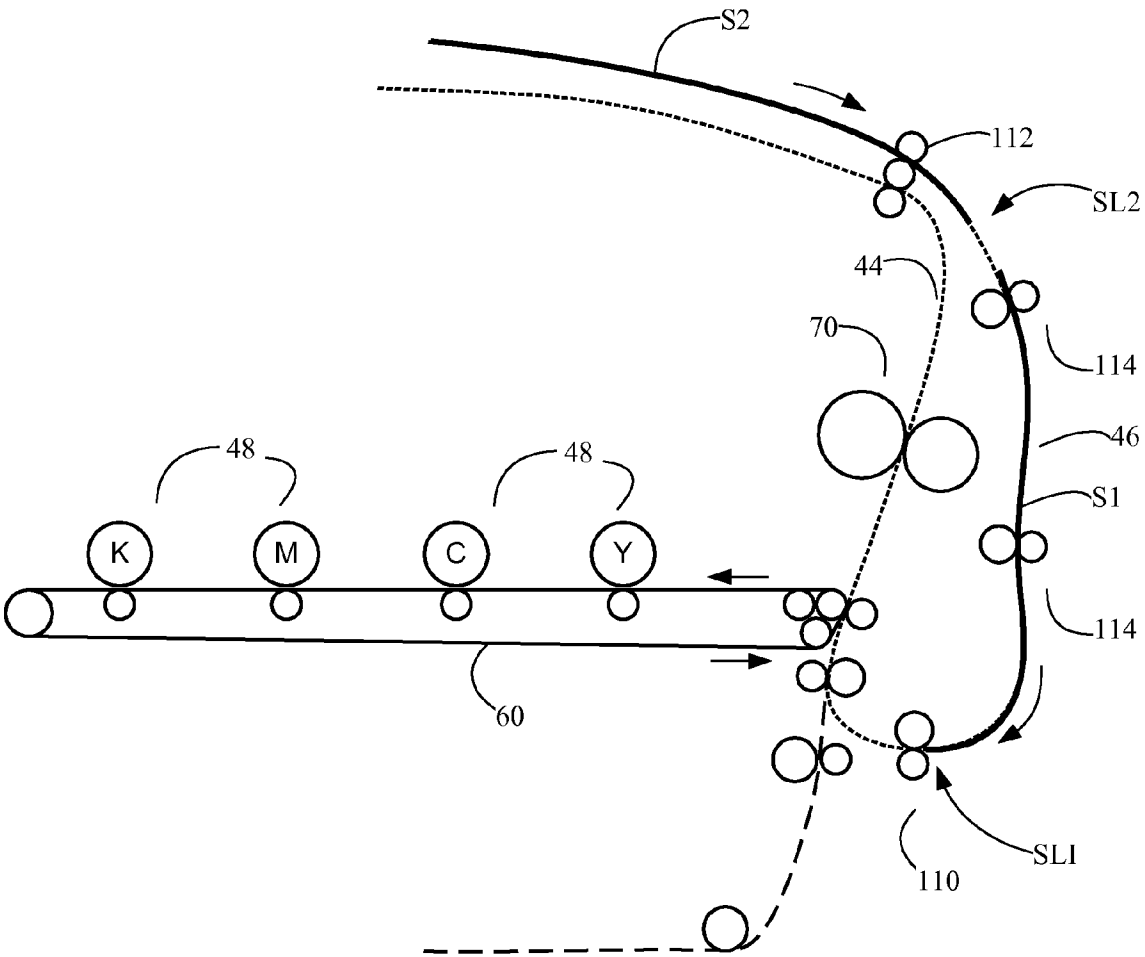
FIG. 2 is a simplified side view of a portion of the imaging device of FIG. 1 showing the duplex path thereof.

With reference to FIGS. 1 and 2, duplex media path 46 may include sets of rollers for controlling the movement of media sheets within the duplex path. A first set of rollers 110 may be disposed near the end of the duplex media path 46. The second set of rollers 112, which may also serve as exit rollers for moving media sheets to output area 28 from the first media path 44, may be disposed near the beginning of the duplex media path 46. Additional sets of rollers 114 may be disposed between the first set 110 and the second set 112 along the duplex media path 46.

In accordance with an example embodiment, the length of duplex media path 46 is sized for simultaneously holding at least portions of at least two sheets of media. FIG. 2 illustrates two sheets of media, S1 and S2, held within the duplex media path 46, with a leading edge of media sheet S2 held and controlled by the second set of rollers 112 and a trailing edge of media sheet S2 extending out over output media area 28. A leading edge of media sheet S1 is engaged with or positioned immediately upstream of the first set of rollers 110, and a trailing edge of media sheet S1 is positioned in proximity with and just downstream of the leading edge of media sheet S2. When both of the media sheets S1 and S2 are positioned within the duplex media path 46, media sheet S1 is engaged with one or more of the sets of rollers 114.

In an example embodiment, the second set of rollers 112 includes at least one driven roller individually controlled by the controller 90. The second set of rollers 112 may be controlled to move media sheets from the fuser assembly 70 to either output media area 28 or duplex media path 46. In this regard, during a duplex printing operation, the second set of rollers 112 may be controlled by controller 90 to rotate in both directions to move media sheets in a "peek-a-boo" manner as discussed in U.S. Pat. No. 7,130,574, assigned to the assignee of the present disclosure, the content of which is hereby incorporated by reference herein in its entirety.

The first set of rollers 110 may include a driven roller individually controlled by the controller 90 to move media sheets through the upstream end of the duplex media path 46 and towards the second transfer area 40. In addition or the alternative, one or more of the sets of rollers 114 may include a driven roller that is controlled by the controller 90. The controller 90 may control the driven roller(s) of the sets of rollers 114 independently of the control of the driven roller of the first set of rollers 110. This independent control may facilitate the leading edge of a media sheet being relatively precisely positioned at the immediate upstream side of first set of rollers 110, after which movement of the media sheet through first set of rollers 110 and towards the second transfer area 40 may be relatively precisely controlled. Alternatively, the controller 90 controls the driven roller(s) of the sets of rollers 114 and the driven roller of the first set of rollers 110 in a similar or the same way.

As mentioned, the length of the duplex media path 46 may be sized to hold at least portions of at least two media sheets therein, even if a trailing edge of a second media sheet partly extends from the entrance of the duplex media path 46 as shown in FIG. 2. In particular, the controller 90 may control the first set of rollers 110, the second set of rollers 112 and the additional set(s) of rollers 114 so as to, for example, define a first staging location SL1 and a second staging location SL2 in the duplex media path 46 at which leading edges of the first media sheet S1 and/or the second media sheet S2, respectively, may be held, at least temporarily. The distance from first staging location SL1 to the second transfer area 40 may be set to allow for sufficient acceleration to occur for a media sheet S1 to reach the second transfer area 40 at the desired process speed. In one embodiment, the distance between the first staging location SL1 and the second staging location SL2 may be sized to hold at first staging location SL1 the longest media sheet imaging device 10 is configured to be printed in duplex mode without affecting the duplex media path 46 holding, staging and/or parking a second media sheet S2 at or near the second staging location SL2. For example, if the longest media sheet imaging device 10 is configured to print in a duplex printing operation is an A4 sheet, then the distance between first staging location SL1 and second staging location SL2 may be more than the length of an A4 sheet. It is understood, however, that the distance between staging areas SL1 and SL2 may be less than the length of the longest media sheet.

While loading or unloading a duplex printing sequence that alternates the printing of front and back sides of media sheets, a "skip" refers to the gap between two adjacent, duplexed media sheets that both had their first side printed or both had their second side printed. Skip(s) can be intentionally injected by controller 90 in order to provide sufficient gap between two media sheets such that another media sheet from media input tray 26 can be picked and have its first side printed between the two sheets having their second sides printed. Skip(s) also occurs when a duplex print job is near completion and requires no additional pages from media input tray 26.

The skip may be approximately equal to the length of a media sheet plus the gaps that are desired immediately before and after a media sheet, but may be different depending on the duplex paper path and control of the media sheet. For example, the first side of a duplex print job could be routed through first and second media paths 44, 46 faster than normal in order to reduce the length of a skip gap. If the duplex paper path 46 is capable of staging all of the sheets that are printed on the first pass before the first sheet of the duplex print job has its second pass printed, the loading skip can be reduced or eliminated.

A duplex path of an imaging device is considered to be "fully loaded" when the duplex path includes a sufficient number of media sheets so that no skips are present. The "pitch" of an imaging device refers to the number of media sheet sides that is printed by an imaging device having a fully loaded duplex path from a time immediately following the printing of a first side of a media sheet up to and including the second side thereof.

In accordance with an example embodiment, the controller 90 may selectively stage one or more media sheets in duplex media path 46 as needed so that operations neither involving the staged media sheets nor use of the duplex media path 46 may be performed. With the controller 90 being able to control the sets of rollers in the duplex media path 46 to stage one or more media sheets in duplex media path 46 as needed, a printing operation involving one or more print jobs does not need to have all of the media sheets that have been already picked completely flushed from imaging device 10 in order to perform such operation and subsequently reloaded to complete the printing operation. Instead, media sheets on which one side has been printed and that are staged in the duplex media path 46 may be simply moved towards the second transfer area 40 following completion of such activity so as to complete the printing operation. Controller 90 may control the time during which one or more media sheets remain staged in the duplex media path 46 for any amount of time needed to perform virtually any operation during a printing operation without inefficiently flushing sheets that are in process and reloading new sheets.

For example, the controller 90 may stage media sheets in the duplex media path 46 during a printing operation in order to change printing modes of operation. During a print operation of one or more print jobs, imaging device 10 may switch between a color mode of operation in which a plurality of the imaging units 48 are run to deposit one or more color planes of toner onto ITM 60, and a "black only" mode of operation in which only the imaging unit 48 associated with black toner is run to deposit a black color plane onto ITM 60. In general terms, switching between the color mode and the black only mode during a printing operation in which sides of media sheets to be printed only require black images may reduce churn without appreciably decreasing processing throughput using the above-described sheet staging capability within the duplex media path 46. The following illustrates an advantage of the example embodiments of the present disclosure. In duplex printing, the back side of the sheet is typically printed first and the front side of the sheet is printed second so that the front side is stacked in the output face down and is properly collated. For an imaging device having a "three pitch" paper path, the first sheet needs to travel a distance of three sheets in order to print its second side. Each extra sheet of travel is called a "skip" and causes additional churn on the system. The duplex print sequence for a two side (one sheet) print job can then be written as B1 (i.e., image on the back of sheet 1), skip, skip, F1 (image on the front of sheet 1). For an 8 side, 4 sheet, duplex print job the print sequence becomes B1, skip, B2, F1, B3, F2, B4, F3, skip, F4.

This terminology can be expanded to include the color content of each side printed by using a "c" for color and a "k" for black only content as follows:

B1c, skip, B2c, F1c, B3k, F2k, B4k, F3k, skip, F4k.

This complete sequence could be printed with the imaging units 48 in the color mode, but would undesirably create extra churn for the color imaging units 48 since they do not need to be running for the last five sides printed. Therefore, a print mode change from color mode to black only mode may be undertaken. Ideally, this mode change would happen between the F1c side and the B3k side. However, in order to perform a mode change the interpage gap is increased so there are no images being transferred when the mode change takes place. Because the motion of the ITM 60 may be disturbed by the mode change and produce a print defect, some current printers set this interpage gap increase to be long enough that the duplex print sequence becomes broken and the print job is split up into a color section and a black only section. In order to split the job, printing of sheet 2 must be completed before the mode change and printing of sheet 3 starts after the mode change. This amounts to flushing and reloading of the paper path. The result is that F2 is printed before B3 with the mode change occurring between them. The print sequence then becomes:

B1c, skip, B2c, F1c, skip, F2k, mode change, B3k, skip, B4k, F3k, skip, F4k.

As can be seen, two more sheet skips are added to the print sequence, resulting in more churn. One additional complication is a rule used by some printer manufacturers relating to duplex printing as follows: if one side of a sheet is printed in color mode then the other side is also printed in color mode. This restriction arises from the fact that the interpage gap previously was only created when a sheet is picked from the media input tray. The gap is determined by the pick timing between the first and second sheets. Once the sheets are picked, the interpage gap is maintained relatively constant throughout the remainder of the paper path. The result is that some black sides are printed in color mode. These are indicated in the print sequence by an underline (i.e., F2kindicates that this black side was printed while in color mode) and the print sequence becomes B1c, skip, B2c, F1c, skip, , mode change, B3k, skip, B4k, F3k, skip, F4k.

As can be seen, churn and the time taken to complete the print job have undesirably increased.

As explained above, example embodiments include the ability of controller 90 to stage one or more media sheets in the duplex media path 46 during a printing operation as needed. Utilization of this feature to the above illustration results in a print sequence for the above-described eight sided, duplex print job as:

B1c, skip, B2c, F1c, mode change, B3k, F2k, B4k, F3k, skip, F4k, with all of the black sides being printed in black only mode, thereby saving churn on the color imaging units. Also of note is the number of skip operations has reduced the amount of time to complete the print job.

Further, because first set of rollers 110 and second set of rollers 112 are individually controllable by controller 90, controller 90 may temporarily park a first sheet of media at first staging location SL1 while moving a second media sheet into duplex media path 46. Specifically, with a first sheet of media already disposed in duplex media path 46 at or near first staging location SL1, controller 90 may control a second sheet of media to move relatively slowly toward and subsequently within duplex media path 46. If the interpage gap ahead of the first sheet of media is small, the second media sheet may not stop at staging location SL2 or elsewhere in duplex media path 46. On the other hand, if the interpage gap ahead of the first media sheet is large, the first media sheet may be temporarily parked at first staging location SL1 and the relatively slow moving second media sheet may likewise be temporarily parked once it arrives at second staging location SL2. Because a trailing edge of the second media sheet may extend from imaging device 10 during at least part of this time, an advantage of relatively slowly moving the second media sheet is that a user would be less likely to perceive the second media sheet as forming a paper jam in imaging device 10 and attempt to manually pull the sheet therefrom.

The example above describes how one or more media sheets may be placed in duplex media path 46 while imaging device 10 switches from the color mode of operation to the black only mode of operation so as to reduce churn. It is understood that imaging device 10 may also may be operated to reduce churn by switching from the black only mode of operation to the color mode of operation during a printing operation while one or more media sheets are maintained in duplex media path 46. In particular, switching from the black only mode to the color mode of operation requires a relatively large amount of time because engaging the transfer rolls of the color imaging units 48 (magenta, cyan and yellow) and starting color cartridge activity therefor may perturb ITM 60 and cause a print defect in the last sheet imaged in the black only mode. By temporarily parking a first media sheet at first staging location SL1, printing of the last sheet in the black only mode may be completed and subsequently the last sheet may be moved towards second staging location SL2 while imaging device 10 switches from the black only mode of operation to the color mode. By maintaining one or more sheets of media in duplex media path 46, imaging device 10 may switch from black only mode to color mode with less churn and less of an impact on media throughput.

It is understood that the above examples are only isolated cases for the purpose of illustration. In order to get a more generalized understanding of the efficiency of this enhanced duplex printing method, a study was undertaken of churn created during printing of print jobs ranging from one to six sides per job, with all possible combinations of color and black sides printed. The study contrasted simplex printing, duplex printing using prior methods (hereinafter "standard duplex printing"), and the enhanced duplex method described above (i.e., utilizing the ability to stage one or more media sheets in the duplex media path 46 during the interruption of a printing operation) to see how much churn would be created by each printing method. Simplex printing using print mode changes used an average of about 6.5 revolutions of the PC drums 54 per side of media sheet. Standard duplex printing with print mode changes used an average of about 9.4 revolutions of the PC drums 54 per side of the media sheet. Enhanced duplex printing with print mode changes used an average of about 7.8 revolutions of the PC drums 54 per media sheet side. The enhanced duplex printing method reduced the increase in churn from simplex to duplex by about 56%. A useful point of comparison is printing continuously with no print mode changes, was determined to use about 3.5 revolutions per side printed.

By changing print modes during a printing operation through use of staging media sheets in the duplex media path 46, one side of a sheet of media may be printed in the color mode and a second side of the sheet printed while in black only mode, thereby eliminating conformance to the above-mentioned rule.

The above-described capability of staging one or media sheets in the duplex media path 46 may not only be used in duplex printing in order to reduce churn, but may also be used in other instances in which a temporary suspension of a printing operation or an increase in the interpage gap is needed. For example, a component in the fuser assembly 70 may become overheated during a printing operation due to printing on narrow media and may need to increase the interpage gap in order to better maintain fuser temperatures within desired limits. The interpage gap may be efficiently increased during the printing operation for media sheets in the media transport path (the first media path 44 and the duplex path 46) at least partly by delaying the media sheets in the duplex path 46 as needed before the sheets are sent to the second transfer area 40.

The example embodiments have been described for use in an imaging device having an architecture in which toner is transferred in a two step process using ITM 60. It is understood that the capability of staging media sheets in a duplex path according to the example embodiments may also be used in imaging devices having an architecture in which toner is transferred in a single step process by imaging units 48 transferring toner directly onto media sheets.

In addition, in an example embodiment the distance each PC drum 54 of a color imaging unit 48 travels from the start of its acceleration ramp until imaging and the distance travelled from starting its deceleration until stopping is reduced and may be substantially minimized. These distances are more than one PC drum revolution in order to provide suitable PC drum charging during run-in and to provide substantially uniform PC drum charging after run-out. Further, the distance that each PC drum 54 of a color imaging unit 48 travels as its corresponding transfer roll is moved into or out of engagement with the PC drum 54 followed by the distance the PC drum 54 moves during the time for motion disturbances in the ITM 60 to subside, should be less than the standard interpage gap distance. The interpage gap distance may be determined by the process speed and the time it takes to reliably pick a page from the paper tray 26. If the above-mentioned move time plus the settle time for the ITM 60 is no longer than the pick time then the interpage gap does not need to be increased for a change from the color mode to the black only mode. The interpage gap needed for changing from the black only mode to the color mode may be determined to be the distance from the first of the first toner transfer areas 38 to the last thereof, i.e. from the yellow (Y) imaging unit 48 to the black (K) imaging unit 48, plus the move and settle time multiplied by the process speed. This ensures that no image is in first transfer while the print mode change takes place. The motion of the ITM 60 at second transfer area 40 may be isolated from the motion from the print mode change at first transfer 38 so that an image can be in second transfer area 40 when the print mode change takes place.

The embodiments described above with respect to FIGS. 1 and 2 show for illustrative purposes a three pitch paper path in which one or two sheets of media may be disposed within duplex media path 46 and independently staged by one or two sets of rollers. It is understood that imaging device 10 may have a paper path pitch of less than or greater than three. In the latter case, duplex media path 46 may include one or more additional sets of rollers for moving media sheets therethrough and staging media sheets in duplex media path 46. In general terms, imaging device 10 having a paper path pitch of Y that is capable of staging X pages in its duplex media path may be able to adjust the interpage gap without flushing and reloading the duplex media path. For each odd numbered paper path pitch value of Y, the number of pages X that can be staged in the duplex media path may be represented as $X=(Y+1)/2$; and for each even numbered paper path pitch value of Y, the number of pages X that can be staged may be seen as Y (i.e., $X=Y$).

FIGS. 1 and 2 further show an imaging device 10 capable of color imaging. It is understood that, alternatively, imaging device 10 may be a monochromatic imaging device and include only a single imaging unit 48 for depositing black toner onto media sheets. In this alternative embodiment, during an interruption of a printing operation, one or more media sheets may be maintained or staged within the duplex media path for reasons other than switching between color and black only modes of operation.

The foregoing description of several methods and example embodiments has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An imaging device, comprising:

a plurality of imaging units, each imaging unit selectively deposits toner forming a color plane;

an intermediate transfer member for cooperating with the imaging units such that the color planes of toner are deposited on the intermediate transfer member;

a second transfer area for transferring the deposited color planes of toner from the intermediate transfer member to sheets of media as the sheets of media are movably positioned in the second transfer area;

a media transport path configured for picking the sheets of media from a stack thereof and moving the picked sheets of media to and from the second transfer area;

a fusing assembly positioned downstream of the second transfer area for fusing deposited toner to the sheets of media; and at least one controller for controlling the imaging units, intermediate transfer member, second transfer area, media transport path and fusing assembly;

wherein the media transport path includes a duplex path for selectively moving the media sheets from a first location downstream of the fusing assembly to a second location upstream of the second transfer area, the duplex path including at least one set of rollers, each set of rollers controlled by the controller for moving the media sheets through the duplex path and selectively staging at least one media sheet of the sheets of media therein, and wherein one of the imaging units is a black imaging unit for transferring black toner, the imaging device is configurable in a color mode of operation in which one or more of the imaging units is run and a black only mode of operation in which only the black imaging unit is run, and the controller switches between the color mode and the black only mode during a printing operation without changing an order in which sides of each media sheet are printed, relative to the sides thereof being printed in an absence of switching between modes of operation, and, without changing an order in which each media sheet is printed, relative to the sheets of media being printed in an absence of switching between modes of operation.

2. The imaging device of claim 1, wherein the at least one set of rollers comprises first and second sets of rollers individually controlled by the controller.

3. The imaging device of claim 1, wherein the imaging device is configured to concurrently control movement of at least two of the media sheets at least partly in the duplex path independently of each other.

4. The imaging device of claim 1, wherein a first side of a first media sheet of the at least one media sheet is selectively imaged in one of the color mode of operation and the black only mode of operation and a second side of the first media sheet is selectively imaged in the other of the color mode of operation and the black only mode of operation.

5. The imaging device of claim 1, wherein the controller selectively stages the at least one media sheet in the duplex path during a time the imaging device switches between the color and black only modes of operation.

6. The imaging device of claim 5, wherein the controller controls an amount of time during which the at least one media sheet remains in the duplex path as the imaging device switches between the color mode of operation and the black only mode of operation.

7. The imaging device of claim 1, wherein the controller switches between the color mode (c) and the black only mode (k) during the printing operation using a printing sequence of B1c, skip, B2c, F1c, mode change, B3k, F2k, B4k, F3k, skip, F4k, with Bn and Fn being a back and a front side of the n-th sheet of media, respectively, and each skip being an extra sheet of travel where there is no media sheet in the second transfer area and no switching between the modes of operation.

8. The imaging device of claim 1, wherein the controller temporarily parks a first media sheet of the at least one media sheet in the duplex path at a first staging location while moving a second media sheet at least partly in the duplex path relative to a second staging location therein so that a trailing edge of the second media sheet extends from the imaging device, a speed of the second media sheet being such that the trailing edge thereof is not visibly motionless and a gap between the parked first media sheet and a leading e of the second media sheet is maintained.

9. An imaging apparatus, comprising:

one or more imaging units, each imaging unit selectively deposits toner forming a color plane;

a media transport path configured for picking media sheets from a stack thereof and moving the media sheets in the imaging apparatus to receive one or more formed color planes;

a fusing assembly positioned along the media transport path for fusing deposited toner to the media sheets; and at least one controller for controlling the one or more imaging units, media transport path and fusing assembly;

wherein the media transport path includes a duplex path for selectively moving the media sheets from a first location downstream of the fusing assembly to a second location upstream of a point in the media transport path at which the media sheets receive toner, the duplex path including at least one set of rollers, each set of rollers controlled by the controller for staging at least one media sheet of the media sheets therein, and wherein the one or more imaging units comprises a plurality of imaging units, one of the imaging units is a black imaging unit for transferring black toner, the imaging device is configurable in a color mode of operation in which at least one of the imaging units is run and a black only mode of operation in which only the black imaging unit is run, and the controller switches between the color mode and the black only mode during a printing operation without changing an order in which sides of each media sheet are printed, relative to the sides thereof being printed in an absence of switching between modes of operation, and without changing an order in which each media sheet is printed, relative to the media sheets being printed in an absence of switching between modes of operation.

10. The imaging apparatus of claim 9, wherein the at least one set of rollers comprises first and second sets of rollers individually controlled by the controller independent of each other.

11. The imaging apparatus of claim 9, wherein a first side of a first media sheet of the media sheets is imaged in one of the color mode of operation and the black only mode of operation and a second side of the first media sheet is imaged in the other of the color mode of operation and the black only mode of operation.

12. The imaging apparatus of claim 9, wherein the controller stages the at least one media sheet in the duplex path during a time the imaging apparatus switches between the color and black only modes of operation.

13. The imaging apparatus of claim 12, wherein the controller controls an amount of time during which the at least one media sheet remains in the duplex path as the imaging device switches between the color mode of operation and the black only mode of operation.

14. The imaging apparatus of claim 9, wherein the controller switches between the color mode (c) and the black only mode (k) during the printing operation using a sequence of B1c, skip, B2c, F1c, mode change, B3k, F2k, B4k, F3k, skip, F4k, with Bn and Fn being a back and a front side of the n-th sheet of media, respectively, and each skip being an extra sheet of travel where there is no media sheet in the second transfer area and no switching between the modes of operation.

15. The imaging apparatus of claim 9, wherein the controller controls an amount of time during which the at least one media sheet remains in the duplex path so as to adjust an interpage gap between the at least one media sheet and another of the media sheets.

16. The imaging apparatus of claim 9, wherein the at least one controller temporarily parks a first media sheet in the duplex path at a first staging location while moving a second media sheet at least partly in the duplex path relative to a second staging location therein so that a trailing edge of the second media sheet extends from the imaging apparatus, a speed of the second media sheet being such that the trailing edge thereof is not visibly motionless and a gap between the parked first media sheet and a leading edge of the second media sheet is maintained.

17. An imaging device, comprising:

imaging units for use in transferring toner to media sheets, one of the imaging units comprising a black imaging unit for transferring black toner;

a media transport path having a duplex path, the duplex path having at least one set of rollers for moving the media sheets through the duplex path; and a controller operatively coupled to the imaging units and the media transport path, for staging one or more of the media sheets in the duplex path for a period of time during which the imaging device switches between a color mode of operation in which at least one of the imaging units is run and a black only mode of operation in which only the black imaging unit is run, wherein the controller switches between the color mode and the black only mode of operation during a printing operation without changing an order in which sides of each media sheet are printed, relative to the sides thereof being printed in an absence of switching between modes of operation.

18. The imaging device of claim 17, wherein the imaging device is configurable by the controller to print on a first side of a first sheet of the one or more media sheets while in one of the color mode of operation and the black only mode of operation and a second side of the first sheet of the one or more media sheets while in the other of the color mode of operation and the black only mode of operation.

19. The imaging device of claim 17, wherein the staging results in increasing an interpage gap between media sheets.

20. The imaging device of claim 17, wherein the controller switches between the color mode (c) of operation and the black only mode (k) of operation during the printing operation without changing an order in which the media sheets are printed, relative to the media sheets being printed in an absence of switching between the modes of operation, using a sequence of B1c, skip, B2c, F1c, mode change, B3k, F2k, B4k, F3k, skip, F4k with Bn and Fn being a back and a front side of the n-th sheet of media, respectively, each skip being an extra sheet of travel where there is no media sheet in the second transfer area and no switching between the modes of operation.

* * * * *